United States Patent [19]

Meyers

[11] 3,995,330

[45] Dec. 7, 1976

[54] SHOWER SHELVING UNIT

[76] Inventor: Robert D. Meyers, P.O. Drawer "B", Chester, Md. 21619

[22] Filed: Aug. 20, 1975

[21] Appl. No.: 606,097

[52] U.S. Cl. ..... 4/146

[51] Int. Cl.[2] ..... A47K 17/00

[58] Field of Search ..... 4/145, 146, 175, 173, 4/149, 148, 2, 4, 5

[56] References Cited

UNITED STATES PATENTS

| | | | |
|---|---|---|---|
| 1,582,881 | 4/1926 | Kraemer | 4/146 |
| 1,691,339 | 11/1928 | Deming | 4/146 |
| 2,197,385 | 4/1940 | Ricken | 4/149 |
| 2,594,049 | 4/1952 | Matos | 4/149 |
| 3,021,576 | 2/1962 | Conroy | 4/149 |

*Primary Examiner*—Robert I. Smith
*Attorney, Agent, or Firm*—Lowe, King, Price & Markva

[57] ABSTRACT

A do-it-yourself shelving unit designed for easy installation with existing shower stalls and adaptable for use with either curtain or sliding door-type shower stalls. The shelving unit comprises three basic pieces including a horizontal shelf, a vertical shield, and a retaining member, plus mounting brackets. The shelving unit may be cut to size for mounting on the top of the existing stall curtain or door so as to provide a convenient and handy shelf for toiletry articles and the like.

11 Claims, 7 Drawing Figures

SHOWER SHELVING UNIT

BACKGROUND OF THE INVENTION

1. Field of the Invention

The present invention is related to an accessory for a shower stall and, more particularly, is directed towards a mass produceable, do-it-yourself custom shelving unit intended for installation and utilization with existing shower curtains or sliding door stalls.

2. Description of the Prior Art

A person taking a shower has a need for convenient access to a number of toiletry articles. For example, soap, shampoo, hair rinses, and the like are most expeditiously and conveniently applied while the user is taking a shower.

Contemporary shower stalls, which are conventionally enclosed by either an ordinary shower curtain or by a custom sliding shower door installation, do not provide any convenient means by which such toiletry articles may be stored.

The user of such toiletry articles must therefore either forego usage thereof while taking a shower or, more commonly, is forced to inconveniently reach into and out of the shower stall to retrieve and replace the desired toiletry articles on a shelf located external to the stall. This, in turn, requires the curtain or sliding door to be frequently opened and closed while the shower is running which can defeat the purpose of such protective coverings, normally intended to keep the water inside the stall so as to prevent water damage to external areas.

Such inconveniences may also be dangerous if the user must step from the shower while wet in order to retrieve or replace the desired toiletry articles. In an unguarded moment, the user may slip and become victim to serious injury.

It is common practice to use the rim of the bathtub as a makeshift shelf as another alternative. This is somewhat less than satisfactory since such rims are often too narrow for safe storage. Further, the rims and articles placed thereon, being substantially at knee level, become wet and slippery due to splashing water.

Thus, since very few homebuilders provide custom shelving for such toiletry articles inside the shower stall itself, it is seen that it would be extremely expedient and convenient if an inexpensive and easily installed shelving unit were to be made available.

OBJECTS AND SUMMARY OF THE INVENTION

It is therefore a primary object of the present invention to provide a shelving unit for a shower stall which is inexpensive, easily installed, and adaptable to either a rod-curtain shower stall or a sliding door shower stall.

Another object of the present invention is to provide an inexpensive shower shelving unit which provides means for conveniently and easily holding a large number of toiletry articles while maintaining same out of the general view of an observer outside the shower.

A further object of the present invention is to provide a shelving unit for showing stalls which may be readily marketed as a do-it-yourself type of custom unit, and which is easily installed by most homeowners.

The foregoing and other objects are attained in accordance with one aspect of the present invention through the provision of a custom shelving unit adapted for use in combination with a shower stall which has conventional means, such as a curtain or sliding door, for preventing water from splashing outside the stall. The shelving unit is mounted on top of the curtain rod or sliding door frame and includes a substantially horizontal shelf member which has a substantially vertical shield member joined along a longitudinal edge thereof. The shelving unit further includes upper and lower retaining members each of which has a longitudinally formed slot therein for receiving respective upper and lower edges of the flat vertical shield. The lower retaining member is preferably integrally formed along an edge of the horizontal shelf member, while the upper retaining member includes a second longitudinally formed slot for receiveably engaging a wall mounting bracket. For use with a rod and curtain shower stall, the unit includes a rod-mounting bracket having a rod-receiving aperture formed therethrough and a pair of T-shaped lugs extending along the upper portion thereof for engagement with integrally formed bracket receiving means located on the underside surface of the horizontal shelf member.

BRIEF DESCRIPTION OF THE DRAWINGS

Various objects, features, and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
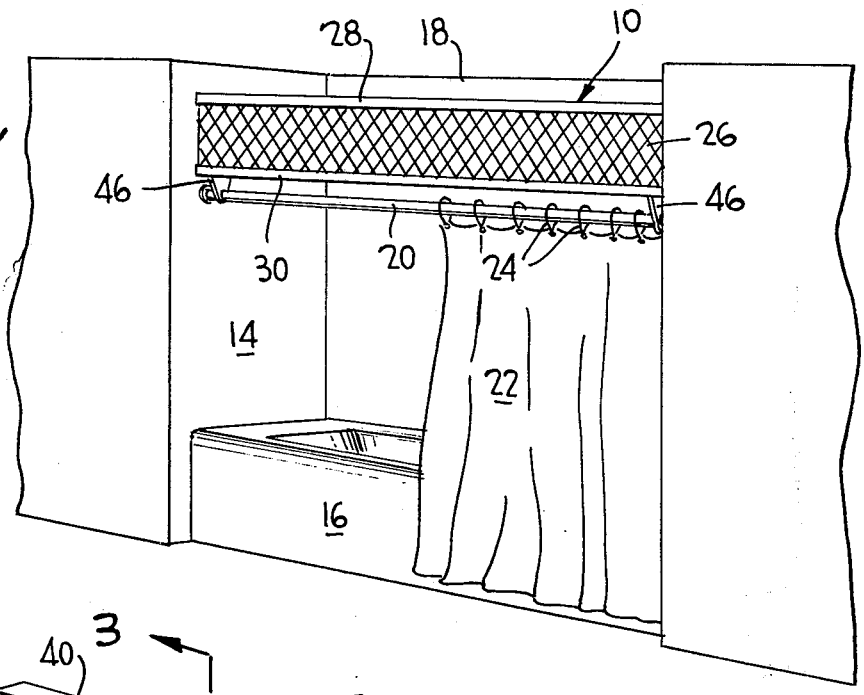
FIG. 1 is a perspective view of a common shower stall having a preferred embodiment of the present invention installed therein.
Figure 2:
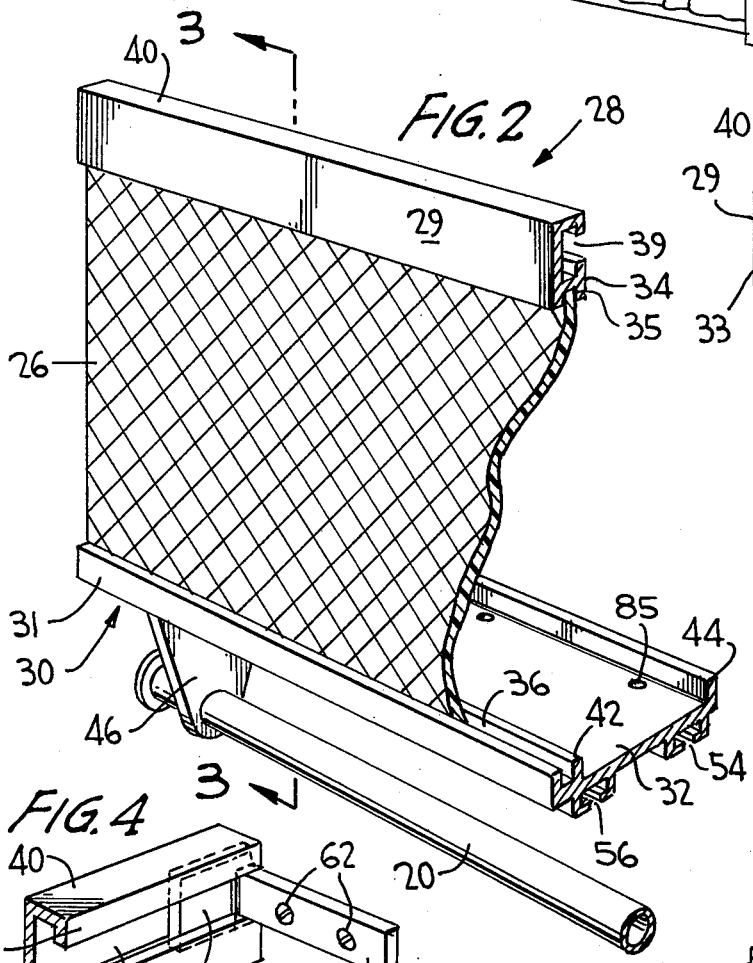
FIG. 2 is a perspective, partially cut-away view illustrating the components of the present invention in somewhat more detail.
Figure 3:
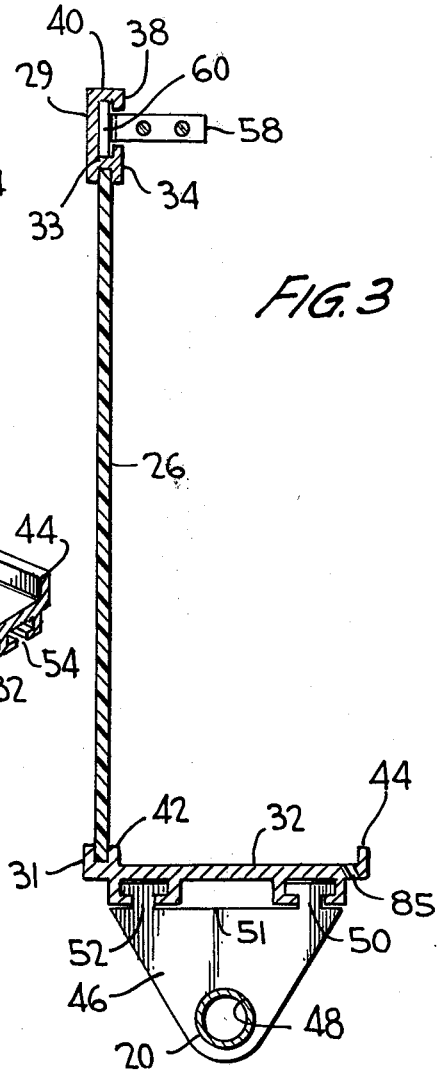
FIG. 3 is a sectional view of the components of the present invention taken along line 3—3 of FIG. 2.

FIGS. 1 through 3 illustrate the components and construction of a first preferred embodiment of the present invention, which is designated generally at 10 in FIG. 1. FIG. 1 exemplifies a standard bathroom shower stall which is defined by parallel side walls 14 (only one of which shows in the view of FIG. 1) and a connecting wall 18.

Positioned within parallel side walls 14 and connecting wall 18 is a standard bathtub 16. In order to prevent water from splashing outside the shower stall, a conventional shower curtain 22 is hung by means of rings 24 from a curtain rod 20 which is conventionally attached at both ends thereof to the parallel side walls 14 of the shower stall. Also connected between parallel side walls 14 of the shower stall is a preferred embodiment of the shower shelving unit 10 of the present invention which, as viewed in FIG. 1, comprises a vertical shield 26 held in place by means of upper and lower retaining members 28 and 30, respectively. The entire unit 10 is connected to curtain rod 20 by means of mounting brackets 46 positoned at both extremities thereof. Vertical shield 26 preferably comprises a somewhat opaque material, such as sculptured or embossed plastic or the like, in order to shield from view the toiletry articles which may be stored on the horizontal shelf therebehind, as will become more clear hereinafter. Alternatively, vertical shield 26 may be a smooth sheet of plastic or the like covered on its outwardly facing surface with wallpaper so as to decoratively match other wallpaper within the bathroom.

FIGS. 2 and 3 illustrate a preferred embodiment of the shower shelving unit 10 of the present invention in somewhat more detail. Shield 26 is seen to comprise a substantially flat rectangular panel mountable within longitudinal slots 35 and 36 of upper and lower retaining members 28 and 30, respectively.

Upper retaining member 28 includes a front face 29, a dual slot forming member 34 oriented substantially parallel to front face 29 and connected thereto by a transverse connecting piece 33. Upper retaining member 28 further includes an upper horizontal connecting piece 40 which joins the upper portion of front face 29 with a downwardly extending rear lip member 38.

Figure 4:
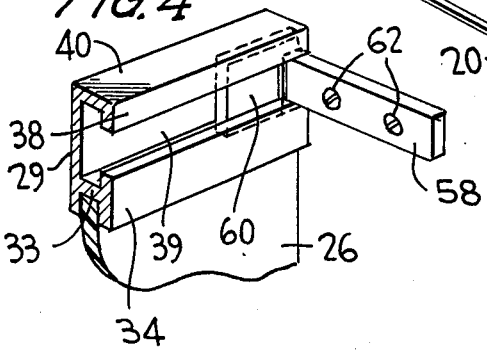
FIG. 4 is an enlarged perspective view illustrating the wall bracket mounting means in accordance with a preferred embodiment of the present invention.

As perhaps best viewed in FIG. 4, the lower portion of front face 29 cooperates with the lower portion of dual slot forming member 34 and connecting piece 33 to form the upper slot 35 which receives and retains the upper edge of panel 26. Members 29, 33, 34, 38 and 40 also form a C-shaped slot 39 which is sized to receive a side bracket extension 60 of a wall mounting bracket 58. A pair of such wall mounting brackets 58 are utilized with each shower shelf installation, one of each of which is intended to be secured to the parallel side walls 14 by means of screws 62.

Lower retaining member 30 includes a substantially flat horizontal shelf portion 32 which is positioned between a pair of substantially parallel, upwardly extending lip members 42 and 44 which extend along the entire length of lower member 30. Lip member 44 is preferably provided as a guard lip to prevent articles stored on shelf 32 from being accidentally pushed off or otherwise dislodged. Lip 42, on the other hand, acts in conjunction with front face 31 to form the lower longitudinally extending slot 36 for receiving the lower edge of panel 26. The width of shelf 32 may be, for example, from 4 to 5 inches, which is ample to accommodate nearly all presently available toiletry articles.

The upper and lower retaining members 28 and 30 are preferably formed of extruded aluminum so as to be easily cut, along with plastic panel 26, to the desired length by conventional tools so as to fit the particular shower stall.

Although the lower shelf 32 of the preferred embodiment depicted in FIGS. 1 through 3 may be fastened directly to the side walls 14 of the shower stall, I have found that greater stability and support is achieved by utilizing a mounting bracket 46 to connect the underside of lower retaining member 30 to the curtain rod 20. As best viewed in FIG. 3, mounting bracket 46 includes a circular aperture 48 formed in the lower portion thereof for receiving rod 20 therethrough. Mounting bracket 46 further has a pair of T-shaped lugs or brackets 50 and 52 which extend upwardly from the substantially flat horizontal upper edge 51 thereof.

Integrally formed on the underside of shelf 32 are a pair of bracket receiving slots 54 and 56 sized to receive the T-shaped brackets 50 and 52, respectively. T-shaped brackets 50 and 52 are slideable within slots 54 and 56 such that the length of the unit may be easily adjusted. Mounting brackets 46 are of sufficient thickness so as to provide sufficient structural support to shelf 32 while obviating the need for wall retaining brackets for the lower retaining member 30. Although only two mounting brackets 46 are illustrated in FIG. 1, it is clear that more than two brackets may be disposed along the length of rod 20 to provide additional structural strength as necessary.

Figure 5:
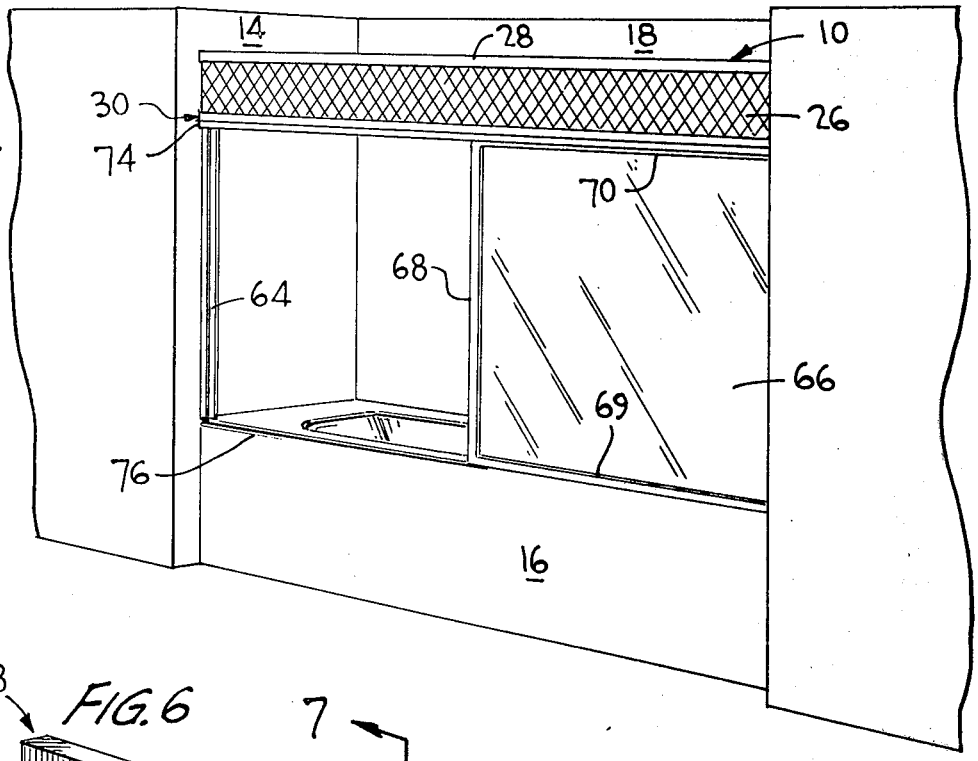
FIG. 5 is a perspective view of another type of conventional shower stall having a preferred embodiment of the present invention installed therein.
Figure 6:
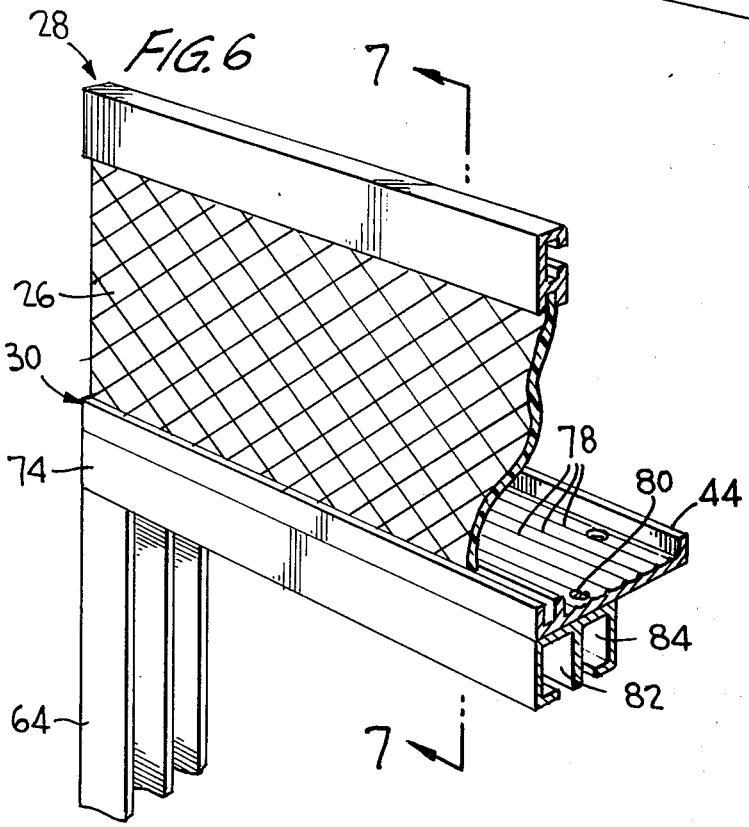
FIG. 6 is an enlarged perspective, partially cut-away view illustrating the components of the embodiment illustrated in FIG. 5 in somewhat more detail.
Figure 7:
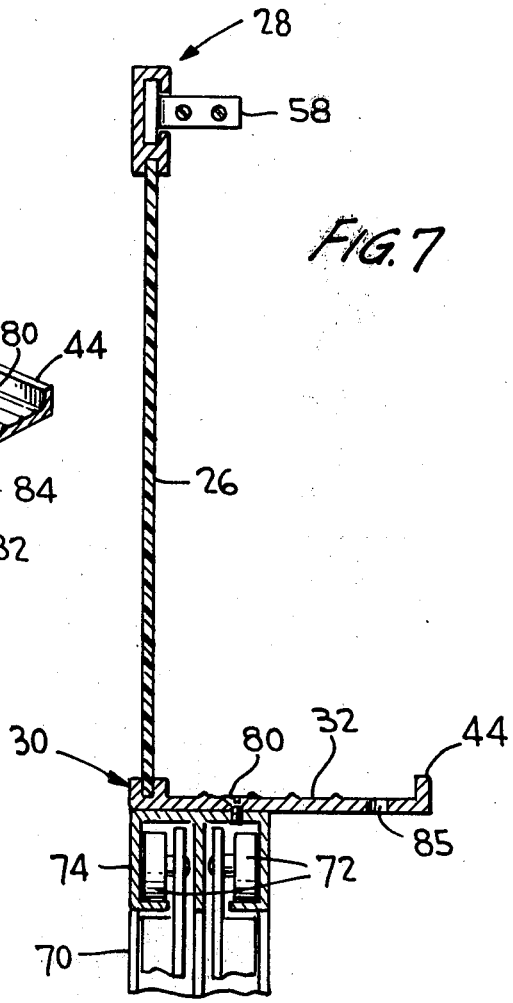
FIG. 7 is a sectional view of the present invention taken along line 7—7 of FIG. 6.

Referring now to FIGS. 5 through 7, an alternative embodiment of the present invention is illustrated in combination with a conventional sliding door shower stall assembly. Referring particularly to FIG. 5, a shower door 66, which may be comprised either of shatterproof glass or plastic, as is well known, is encased within side frames 68 and lower and upper frames 69 and 70, respectively. Lower frame 69 is adapted to move within a lower guide track 76 previously installed on an edge of bath tub 16.

A pair of side support members 64 are installed on each side wall 14 of the shower stall for supporting an upper guide track 74 therebetween. Guide track 74 conventionally includes a pair of roller guide tracks 82 and 84 (FIG. 6) which are adapted to receive a set of rolers 70 and 72 mounted to the upper frame member 70 of door 66, all of which is conventional.

The shower shelving unit 10 of the present invention for use with the sliding door type of shower enclosure consists of basically the same components as those described in connection with the curtain and rod shower enclosure installation described hereinabove, with the notable exception being the lack of necessity of this embodiment for the mounting bracket 46. Thus, the shelving unit 10 in this embodiment essentially comprises an upper retaining member 28, a lower retaining member 30, and a vertical shield or panel 26 disposed within slots formed longitudinally along the edges of upper and lower retaining members 28 and 30. In order to secure the lower retaining member 30 to the upper guide track 74, a number of screw attaching means 80 are provided along the length of horizontal shelf 32, care being taken to provide screws 80 of suitably short lengths so as to prevent interference with rollers 72.

The surface of horizontal shelf 32 may also be provided with a plurality of ripples 78 formed thereon to make the surface more slip resistant with respect to the toiletry articles placed thereon. Further, in both of the embodiments depicted in FIGS. 3 and 7, the horizontal shelf 32 may be designed to provide a slight downward inclination thereof towards vertical lip member 44 so as to provide a means for allowing drainage of water through apertures 85 spaced along the length.

It is therefore seen that I have provided an attractive, easy to assemble, and inexpensive do-it-yourself type of shower shelving unit which may be easily mass produced in suitable lengths and cut to size by the individual consumer to fit any shower stall. Toiletry articles of a considerable number may be placed and stored on the shelf out of view. The unit is installed at a height which is sufficient to prevent the articles placed thereon from becoming unduly wet, while still having them within easy reach of the user. Further, the user need not resort to opening and closing the shower enclosure in order to retrieve and replace the articles, and the unit is provided with a number of guard means to inhibit slippage and accidental droppage.

Although the shelving unit of the present invention has been illustrated in both preferred embodiments in combination with a bath tub type of shower stall, it is clear that the present invention may be equally advantageous when utilized in combination with shower stalls that do not have bath tubs. The basic three piece unit, plus mounting brackets, provides a variety of functions and may be decoratively enhanced to provide additional consumer appeal.

Obviously, numerous modifications and variations of the present invention are possible in light of the above teachings. It is therefore to be understood that within the scope of the appended claims the invention may be practiced otherwise than as specifically described herein.

I claim as my invention:

1. In a shower stall having means for preventing water from splashing outside the stall, the combination therewith of shelving means for holding toilet articles, said shelving means being mounted on top of said water splashing means, wherein said shelving means comprises a substantially horizontal shelf member and a substantially vertical shield member joined at respective edges thereof, said toilet articles being viewable from within said shower stall, said shield member extending above said shelf member and being of sufficient height to shield said articles from view from outside said stall.

2. The combination as set forth in claim 1, wherein said shower stall is defined by two substantially parallel side walls and a connecting wall therebetween, said water splashing preventing means including a water shield and means extending between and mounted to said side walls for supporting said water shield at the top portion thereof.

3. The combination as set forth in claim 2 wherein said water shield comprises a curtain and said supporting means comprises a curtain rod, and wherein said shelving means further comprises a mounting bracket for connecting said shelf member to said curtain rod.

4. The combination as set forth in claim 3, wherein said mounting bracket includes an aperture formed in the lower portion thereof for receiving said curtain rod and bracket projection means extending upwardly therefrom, and wherein said shelf member includes means integrally formed on the underside thereof for receivably engaging said bracket projection means of said bracket member.

5. The combination as set forth in claim 4, wherein said bracket projection means includes two T-shaped lugs projecting upwardly from a horizontal surface of said mounting bracket.

6. The combination as set forth in claim 2, wherein said shield member comprises a substantially flat vertical shield, and wherein said shelving means includes upper and lower retaining members each of which includes a longitudinally formed slot for receiving respective upper and lower edges of said shield, the longitudinally formed slot of said lower retaining member being integrally formed along an edge of said horizontal shelf member.

7. The combination as set forth in claim 6 further comprising bracket means for mounting said upper retaining member to said parallel side walls, said upper retaining member having bracket receiving slot means longitudinally formed therein for receivably engaging said bracket means.

8. The combination as set forth in claim 2, wherein said water shield comprises a sliding door and wherein said supporting means comprises a guide track along which said sliding door is movable, and wherein said shelving means further comprises screw means for mounting said shelf member to the top of said guide track.

9. The combination as set forth in claim 1, wherein said shelf member is downwardly inclined toward the inside of said stall and wherein said shelf member includes a lip extending upwardly from the longitudinal edge thereof opposite the edge to which is joined said vertical shield member.

10. The combination as set forth in claim 9, wherein aperture means is provided adjacent said lip to allow drainage of water from said shelf member.

11. The combination as set forth in claim 1, wherein said shelf member has an upwardly facing rippled surface.

* * * * *